United States Patent [19]

Söderström

[11] Patent Number: 4,815,490

[45] Date of Patent: Mar. 28, 1989

[54] ASSEMBLY SYSTEM FOR TENT AND/OR VEHICLE UNITS

[75] Inventor: Hans S. Söderström, Trelleborg, Sweden

[73] Assignee: Trelleborg AB, Trelleborg, Sweden

[21] Appl. No.: 163,425

[22] Filed: Mar. 3, 1988

[30] Foreign Application Priority Data

Mar. 5, 1987 [SE] Sweden ..... 8700942

[51] Int. Cl.[4] ..... E04H 15/18; E06B 7/16

[52] U.S. Cl. ..... 135/97; 52/173 DS; 14/71.5

[58] Field of Search ..... 135/97, 101; 52/173 DS; 14/71.5

[56] References Cited

U.S. PATENT DOCUMENTS

| | | | |
|---|---|---|---|
| 3,352,314 | 11/1967 | Frommelt et al. | 52/173 DS |
| 3,581,331 | 6/1971 | Fisher et al. | 14/71.5 |
| 3,699,600 | 10/1972 | Gacs et al. | 14/71.5 |
| 3,703,737 | 11/1972 | Eggert | 14/71.5 |
| 3,713,183 | 1/1973 | Belisle | 14/71.5 |
| 3,843,987 | 10/1974 | Lodjic | 14/71.5 |
| 4,574,543 | 3/1986 | Crossom | 52/173 DS |

FOREIGN PATENT DOCUMENTS

| | | |
|---|---|---|
| 0055228 | 11/1981 | European Pat. Off. . |
| 85014124 | 5/1988 | Sweden . |

*Primary Examiner*—J. Karl Bell

*Attorney, Agent, or Firm*—Beveridge, DeGrandi & Weilacher

[57] ABSTRACT

An assembly system comprises a connection tube of flexible sheet material. The connection tube has at its end a rigid frame element which is larger than a rigid frame element formed in similar manner but of smaller dimensions. The larger frame element and the sheet material affixed thereto are pushed through the smaller frame element and drawn tight against the latter for sealingly urging the flexible sheet material thereagainst.

3 Claims, 2 Drawing Sheets

ASSEMBLY SYSTEM FOR TENT AND/OR VEHICLE UNITS

Figure 1:
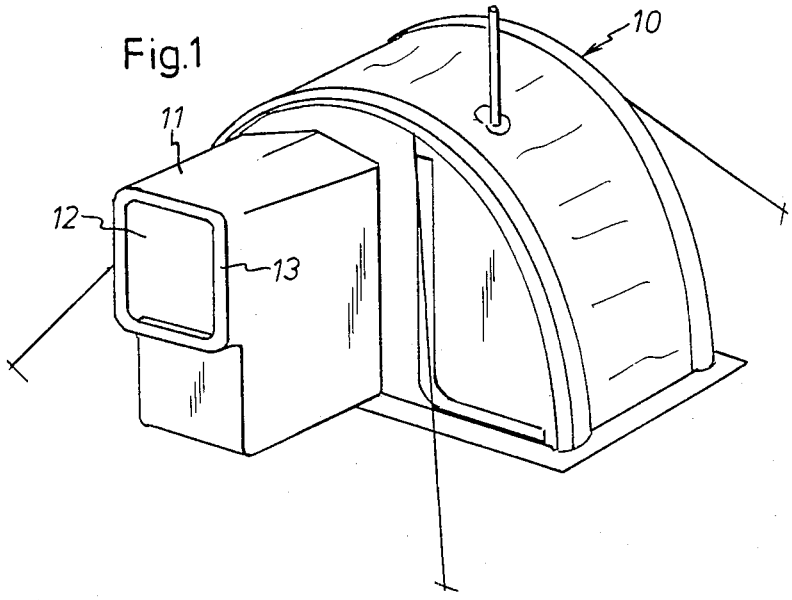

The present invention relates to an assembly system for tent and/or vehicle units, comprising a connection tube which consists of flexible sheet material and has a sealing device for sealing against an adjoining tent or vehicle unit and which serves as a communicating passage between interconnected tent and/or vehicle units.

Assembly systems of this type are useful in connection with command posts, field repair shops, or medical aid stations for military or other purposes.

Tent units equipped with such assembly systems are previously known from the publicly available Swedish patent application 8501412-4 where the connection tube end is provided either with a strip seal associated with a clamping device for clamping the connection tube against the vehicle body while compressing the strip seal, or with a circumferentially extending flap portion to form a lap joint with a light trap section on the associated vehicle. However, the erection of such assembly systems takes time, and furthermore the strip seal may not be tight all-round so that light can leak out.

The published European patent application EP-A-0,055,228 describes an annexing tent especially suited for connection to a passenger car having a rear door. The tent is in the form of a small house having a connection tube by which the tent is connectible to the rear door opening of the car. The free opening end of the connection tube has an elastic frame element which is placed against the outer side of the strip seal of the door frame. The elastic frame element is then pulled down against the strip seal of the door frame into sealing engagement with the seal by means of elastic strap members which are hooked to the underside of the bumper. The rear door is open and inserted in the connection tube to be surrounded thereby. There is no tight seal at the lower door edge, which is unacceptable in situations where tightness is of the essence, for example for military use.

The present invention aims at providing a simple assembly system for tent and/or vehicle units and at making the assembly less time-consuming and more reliable and lightproof.

To this end, the assembly system according to the invention is designed such that the sealing device comprises two stiff or rigid frame elements, one of which is affixed to the connection tube end, while the other is affixed to the adjoining tent or vehicle unit and forms an opening therein, said frame elements being of different sizes but designed in such a manner that the larger frame element can be pushed through the smaller one and, upon assembly, hold the flexible sheet material of the connection tube in sealing contact against one of the two frame elements.

In a preferred embodiment the assembly system according to the invention comprises a connection tube of flexible sheet material, which has at one end a stiff or rigid frame element which is larger than a further stiff or rigid frame element of similar form but smaller dimensions. The larger frame element with the sheet material affixed thereto is pushed through the smaller frame element and drawn tight thereagainst to sealingly engage the flexible sheet material with the smaller frame element.

In an especially preferred embodiment, the larger frame element is affixed to the connection tube in a manner such that it can be detached therefrom. The smaller frame element may be the frame or edge around an opening in a vehicle unit.

Figure 2:
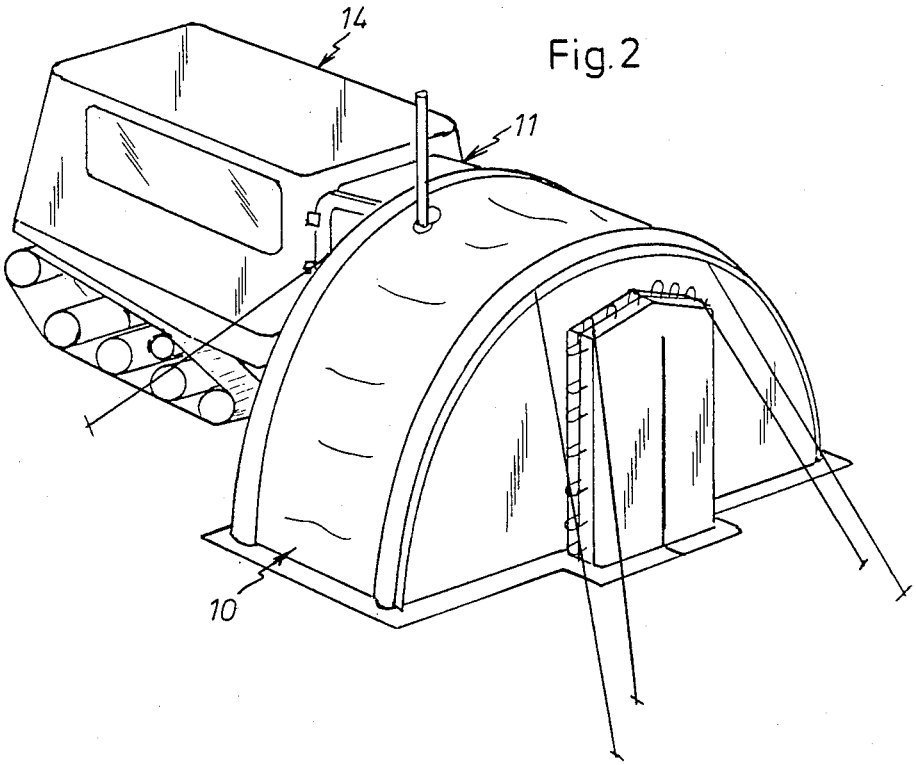
Figure 3:
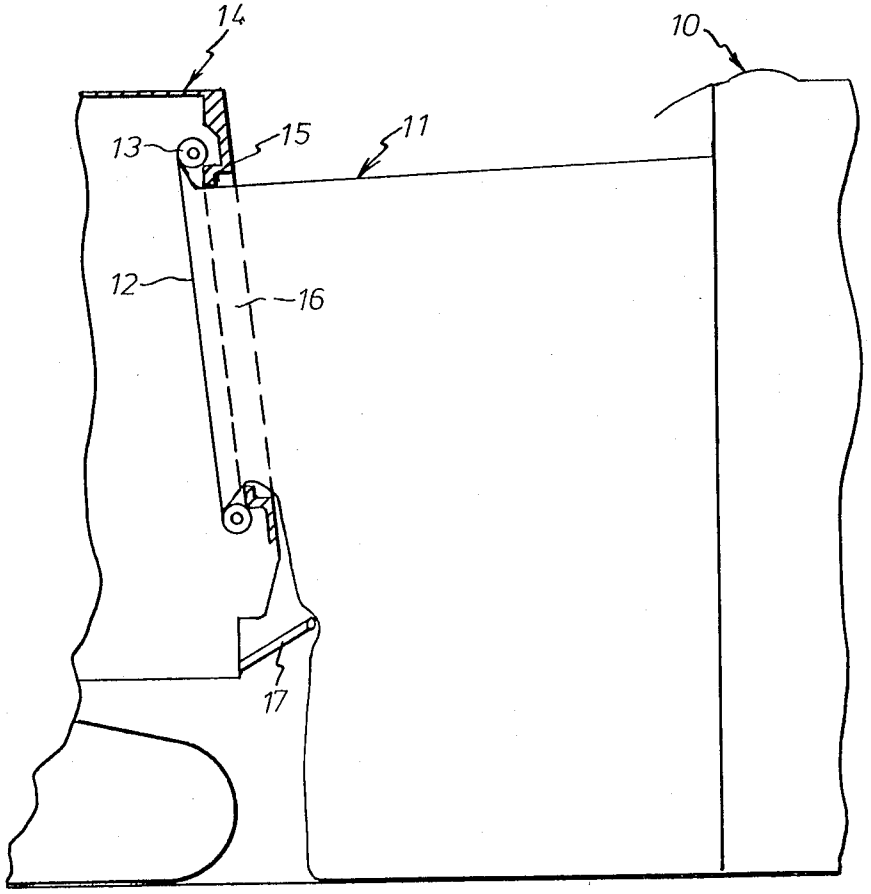

An embodiment of the system according to the invention will be described in more detail below, reference being had to the accompanying drawings in which FIG. 1 is a perspective view of a tent unit with a connection tube included in the embodiment;

FIG. 2 is a perspective view of the same tent unit interconnected with a vehicle unit; and FIG. 3 is a schematic vertical section of this embodiment of the assembly system according to the invention.

The drawings thus illustrate an embodiment of the system according to the invention. FIG. 1 shows a tent unit 10 which has on one end wall a connection tube 11 affixed in a lightproof manner. The connection tube has an opening 12 surrounded by a detachable stiff or rigid frame element 13. In an especially advantageous embodiment, the frame element 13 comprises four glass fiber-reinforced plastic rods detachably interconnected by 90° elbows of fiber-reinforced elastomeric material.

As will appear from FIG. 2, the tent unit in the embodiment illustrated has been connected to a vehicle unit 14 which, as shown in FIG. 3, has a frame 15 forming a stiff or rigid element and defining an opening 16 which, in the embodiment illustrated, has the same geometrical form as the frame element 13, although of smaller size. The dimensions are such that the frame element 13 can be pushed through the opening 16 because one side of the frame element 13 is shorter than the diagonal of the opening 16. Due to the 90° elbows at the corners, the frame element 13 can, if necessary, be slightly deformed. After the frame element 13 has been turned to the position shown in FIG. 3, the vehicle unit can be driven away from the tent to tension the connection tube 11. In this manner, the sheet material of the connection tube will be urged into sealing contact against the frame 15. Furthermore, there is obtained, in the embodiment illustrated, a labyrinth seal preventing the penetration of light from the vehicle or the connection tube.

In the embodiment illustrated, the vehicle has a stirrup 17 which serves as a step so that, when passing through the opening 16 from the tent unit to the vehicle unit, it is possible to step on the tube sheet material in contact with the stirrup 17, without damaging the sheet material.

In the embodiment illustrated, the assembly system has been utilised for interconnection of a tent unit and a vehicle unit. Naturally, the same assembly system may be used for interconnecting two tent units or two vehicle units, in which case it is possible to affix to each end of the connection tube a large stiff or rigid frame element to form an intermediate section between the tent and/or vehicle units to be interconnected. However, the main thing is that there are used at both connection points two stiff or rigid frame elements of different sizes but formed such that the larger frame element can be pushed through the smaller one so that, after assembly, the larger frame element holds the flexible sheet material of the connection tube in sealing contact against one of said two frame elements.

I claim:

1. Assembly system for tent and/or vehicle units (10, 14), comprising a connection tube (11) which consists of flexible sheet material and has a sealing device (12, 13, 15, 16) for sealing against an adjoining tent or vehicle unit and which serves as a communicating passage between interconnected tent and/or vehicle units, characterized in that said sealing device (12, 13, 15, 16) comprises two stiff or rigid frame elements (13, 15), one of which is affixed to the end (11) of the connection tube, while the other is affixed to the adjoining tent or vehicle unit (10, 14) and forms an opening (16) therein, said frame elements being of different sizes but designed in such a manner that the larger frame element (13) can be pushed through the smaller one (15) and, upon assembly, hold the flexible sheet material of the connection tube (11) in sealing contact against one of the two frame elements (13, 15).

2. A system as claimed in claim 1, characterized in that the larger frame element (13) is affixed to the connection tube (11).

3. A system as claimed in claim 2, characterized in that the smaller frame element (15) is the frame or edge around an opening (16) in a vehicle unit (14).

* * * * *